US007107759B2

(12) United States Patent
Annoura et al.

(10) Patent No.: US 7,107,759 B2
(45) Date of Patent: Sep. 19, 2006

(54) APPARATUS FOR REDUCING HYDROCARBON EMISSION OF INTERNAL COMBUSTION ENGINE

(75) Inventors: Toshiki Annoura, Nagoya (JP); Hideki Suzuki, Chita-gun (JP); Koichi Hoshi, Susono (JP); Takaaki Itoh, Mishima (JP)

(73) Assignees: Denso Corporation, Kariya (JP); Toyota Jidosha Kabushiki Kaisha, Toyota (JP)

( * ) Notice: Subject to any disclaimer, the term of this patent is extended or adjusted under 35 U.S.C. 154(b) by 158 days.

(21) Appl. No.: 10/887,327

(22) Filed: Jul. 9, 2004

(65) Prior Publication Data

US 2005/0011185 A1 Jan. 20, 2005

(30) Foreign Application Priority Data

Jul. 11, 2003 (JP) ..... 2003-273732
Jul. 11, 2003 (JP) ..... 2003-273733

(51) Int. Cl.
*F01N 3/00* (2006.01)
*F02M 33/02* (2006.01)

(52) U.S. Cl. ..... 60/283; 123/518; 123/519; 123/520

(58) Field of Classification Search ..... 60/283; 123/518, 519, 520, 521
See application file for complete search history.

(56) References Cited

U.S. PATENT DOCUMENTS 4,085,721 A * 4/1978 Vardi et al. ..... 123/520
4,212,276 A * 7/1980 Kaneda ..... 123/519
5,397,550 A * 3/1995 Marino, Jr. ..... 422/178
5,544,483 A * 8/1996 Heuer ..... 60/283
5,553,577 A * 9/1996 Denz et al. ..... 123/198 D
5,746,187 A * 5/1998 Ninomiya et al. ..... 123/520
5,924,956 A * 7/1999 Kobayashi et al. ..... 477/111
6,412,455 B1 * 7/2002 Ogiso et al. ..... 123/90.11
6,581,580 B1 * 6/2003 Trumpy et al. ..... 123/519
6,637,415 B1 * 10/2003 Yoshioka et al. ..... 123/518

FOREIGN PATENT DOCUMENTS

JP 11-82192 3/1999
JP 2001-227421 8/2001
JP 2001-234781 8/2001

* cited by examiner

*Primary Examiner*—Thomas Denion
*Assistant Examiner*—Loren Edwards
(74) *Attorney, Agent, or Firm*—Nixon & Vanderhye P.C.

(57) ABSTRACT

A canister communicates with an intake manifold of an internal combustion engine through a purge pipe. The canister absorbs fuel vapor evaporated in a fuel tank. The absorbed fuel vapor is purged into the intake manifold when the engine is on. A gas leak check module communicates with the canister for drawing air by an air suction pump 43. When the engine is off, the air suction pump is driven and draws hydrocarbon floating at a vicinity of an intake port through the purge pipe. Thus, the hydrocarbon floating at the vicinity of the intake port is absorbed in the canister so that emission of hydrocarbon is reduced.

29 Claims, 7 Drawing Sheets

APPARATUS FOR REDUCING HYDROCARBON EMISSION OF INTERNAL COMBUSTION ENGINE

CROSS REFERENCE TO RELATED APPLICATION

This application is based on Japanese Patent Application No. 2003-273733 filed on Jul. 11, 2003 and Japanese Patent Application No. 2003-273732 filed on Jul. 11, 2003, the disclosure of which are incorporated herein by reference.

FIELD OF THE INVENTION

The present invention relates to an apparatus for reducing hydrocarbon emission of an internal combustion engine. The hydrocarbon is referred to as HC herein after.

BACKGROUND OF THE INVENTION

In an internal combustion engine, when fuel leaks from a fuel injector, when fuel is blown back from an combustion chamber toward the intake port, or when fuel flows out from a positive crankcase ventilation passage, the fuel containing HC may remain around an intake port with the engine off. A multi-cylinder internal combustion engine, especially, has a remaining fuel in an intake manifold. After the engine is stayed for a certain period in such a state, the remaining fuel evaporates into a floating HC. When the engine is re-started with the floating HC, the floating HC around the intake port is introduced into the combustion chamber and then exhausted as an unburned gas.

To avoid such a problem, some apparatuses have been introduced. JP-11-82192A shows a conventional apparatus in which an absorbent is provided between a throttle valve and an engine in order to absorb the fuel leaking from injection valves. In JP-2001-227421A, a HC absorbent is provided in an intake pipe for absorbing the HC remaining in the intake pipe. JP-2001-234781A shows an apparatus in which the HC remaining in an intake pipe is absorbed in a HC absorbent temporally and then the absorbed HC is purged after activation of a catalyst or after a certain period passed from starting of an engine.

Each of the conventional apparatuses described above has the HC absorbent in the intake pipe of the engine. However, the absorbed HC having a high boiling point is not purged easily. Thus, an absorbing characteristic of the HC absorbent is deteriorated and a sufficient reduction of HC is not achieved.

In JP-2001-227421A, the HC absorbent is disposed upstream of a throttle valve, for example, in an air cleaner, and a canister for absorbing a fuel evaporated in a fuel tank is utilized as the HC absorbent. Since a floating distance of the HC having a high boiling point is shorter than that of the HC having a low boiling point, the HC having a high boiling point does not reach the HC absorbent while the engine is on. On the other hand, when the HC absorbent is disposed upstream of the throttle valve or when the canister is used as a HC absorbent, the HC having a low boiling point around the intake port is not reduced effectively while the engine is stopped. Thus, when the engine is cranked, the floating HC around the intake port is introduced into the combustion chamber and is exhausted as an unburned gas.

SUMMARY OF THE INVENTION

The present invention is made in view of the foregoing matter and it is an object of the present invention to provide an apparatus capable of reducing a hydrocarbon emission.

According to the present invention, an air suction passage is connected with an intake pipe downstream of the internal combustion engine. An HC absorbent for absorbing HC and an air suction pomp for sucking air are disposed in the air suction passage. After the engine is stopped, the air suction pump is operated to suck the floating HC through the air suction passage so that the floating HC around the intake port is absorbed in the HC absorbent.

That is, after the engine is stopped, HC (unburned fuel) and/or engine oil remains around the intake port, one part of which is evaporated to float around the intake port. The floating HC and/or engine oil is sucked into the HC absorbent through the air suction passage by the air suction pump.

While the engine is driven, the HC having a high boiling point and being blown back from the combustion chamber floats around the intake port. In the present invention, the HC absorbent is disposed away from the intake passage via the air suction passage, thus, the floating HC is not absorbed in the HC absorbent so that a deterioration of the HC absorbing characteristic of the HC absorbent is restricted. It is also restricted that the floating HC is introduced into the combustion chamber and exhausted as the unburned gas. That is, the reduction of the HC emission is effectively achieved.

According to the aspect of the invention, a secondary air is injected toward the inlet portion and/or vicinity thereof by an air injection means. The HC absorbent is disposed at a place which communicates with the vicinity of the intake port, and into which the HC of high boiling point hardly flows. While the engine is driven, an airflow is caused by the air injection. Thereby, even after a temperature of the engine is decreased, the floating HC at the vicinity of the intake port is introduced into the HC absorbent in which the HC is absorbed. The HC of high boiling point may flow into the place if the amount of the floating HC does not exceed the predetermined level.

After the engine is stopped, the HC and the engine oil remain at the vicinity of the intake port. The HC of high boiling point is liquefied according as the engine temperature is decreased, and only HC of low boiling point floats at the vicinity of the intake port. While the engine is not driven, the secondary air is injected into the intake passage after the engine temperature is decreased, thereby the HC of low boiling point is effectively absorbed in the HC absorbent.

While the engine is driven, the HC is not absorbed in the HC absorbent and a deterioration of HC absorbing characteristic is restrained since the HC absorbent is disposed at the place to where the floating HC does not flows. Thereby, it is restricted that the floating HC is introduced into the combustion chamber and exhausted as unburned gas. The reduction of HC emission is effectively achieved.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT

Embodiments of the present invention will be described hereinafter with reference to the drawings.

Figure 1:
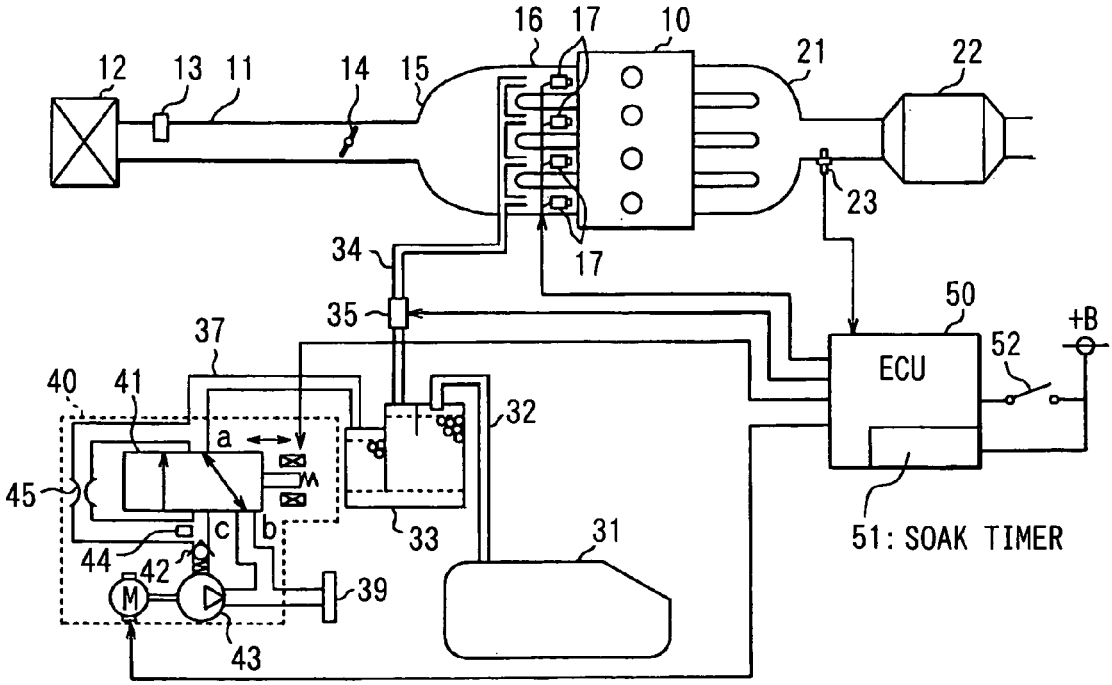
FIG. 1 is a schematic view of an engine control system according to a first embodiment of the present invention.

The present invention is applied to a four-cylinder gasoline injection engine. FIG. 1 is a schematic view showing an engine control system according to a first embodiment.

Referring to FIG. 1, an air-cleaner 12 is disposed at an inlet of an intake pipe 11, and airflow meter 13 for measuring the amount of air passing through the intake pipe 11 is disposed downstream of the air-cleaner 12 in the intake pipe 11. The airflow meter 13 is provided with an intake air temperature sensor (not shown). A throttle valve 14 is provided downstream of the airflow meter 13, which is controlled an opening degree thereof by a DC motor and the like. A surge tank 15 is connected with the intake pipe 11 downstream of the throttle valve 14. An intake manifold 16 for introducing an air into the each cylinder is connected with the surge tank 15. A fuel injector 17 is provided at each intake port of the intake manifold 16. An intake passage is comprised of the intake pipe 11, the surge tank 15 and the intake manifold 16.

A catalyst 22 such as three way catalyst is disposed in an exhaust pipe 21 for purifying CO, HC, $NO_x$ and the like in the emissions. An A/F sensor 23 which detects a ratio of air and fuel is disposed upstream of the catalyst 22. The A/F sensor 23 is a linear A/F sensor or an oxygen sensor.

The engine 10 is provided with a fuel vapor restraining apparatus which restrains a purge of fuel vapor evaporated in a fuel tank 31. One end of a first introducing pipe 32 is connected with the fuel tank 31 and the other end is connected with a canister 33. The canister 33 is filled with an absorbent such as activated carbon for absorbing the evaporated fuel gas. The canister 33 communicates with ambient through a second introducing pipe 37, a solenoid-switching valve 41 and a filter 39 to introduce a fresh air. The canister 33 is connected with the intake manifold 16 through a purge pipe 34 which is provided with a purge control valve 35. When the purge control valve 35 is opened, the negative pressure is introduced into the canister 33 through the purge pipe 34 and fresh air is introduced into the canister 33 through the second introducing pipe 37, then the absorbed fuel is purged into the intake manifold 16. The purge control valve 35 controls the amount of purged fuel gas to the intake manifold 16.

A leaking check module 40 is connected with the second introducing pipe 37. The leaking check module 40 detects a leakage of fuel gas along a fuel evaporating passage including the fuel tank 31, canister 33 and the purge control valve 35. The leaking check module 40 is comprised of the solenoid-switching valve 41, a check valve 42, an air suction pump 43, a pressure sensor 44 and a reference orifice 45. When the solenoid switching valve 41 is not energized, a port "a" is connected with a port "b", and when the valve 41 is energized, the port "a" is connected with a port "c".

When the engine 10 is driven, the purge valve 35 is turned on to open the purge pipe 34 and the solenoid switching valve 41 is positioned to connect the port "a" with the port "b" as shown in FIG. 1 so that fresh air is introduced into the canister 33 by negative pressure to purge the absorbed fuel into the intake manifold 16.

When the fuel leakage detection is executed right after the engine 10 is stopped, the purge valve 35 is turned off to close the purge pipe 34 and the solenoid switching valve 41 is energized to connect the port "a" with the port "c". Thereby, the fuel evaporating passage is closed at both ends. Then, the air suction pump 43 is driven to reduce a pressure in the fuel evaporating passage, the fuel leak detection is executed according to the pressure change at the moment.

An electrical control unit 50, which is referred to as ECU 50 herein after, includes a micro-computer and receives an A/F detection signal from the A/F sensor 23, an air amount signal, an air temperature signal, an engine coolant temperature signal, an engine speed signal, a throttle opening signal and an ignition signal from an ignition switch 52. The ignition switch 52 is referred to as IG switch 52 herein after. The ECU 50 controls the operation of the fuel injection valve 17, the purge control valve 35, the solenoid switching valve 41, the air suction pump 43 and the like. The ECU 50 has a soak timer 51 for measuring an elapsed time since the engine 10 is stopped.

In the present embodiment, the floating. HC at the vicinity of the intake port is absorbed and the HC emissions are restrained. An operation of this embodiment is described herein after.

Figure 2:
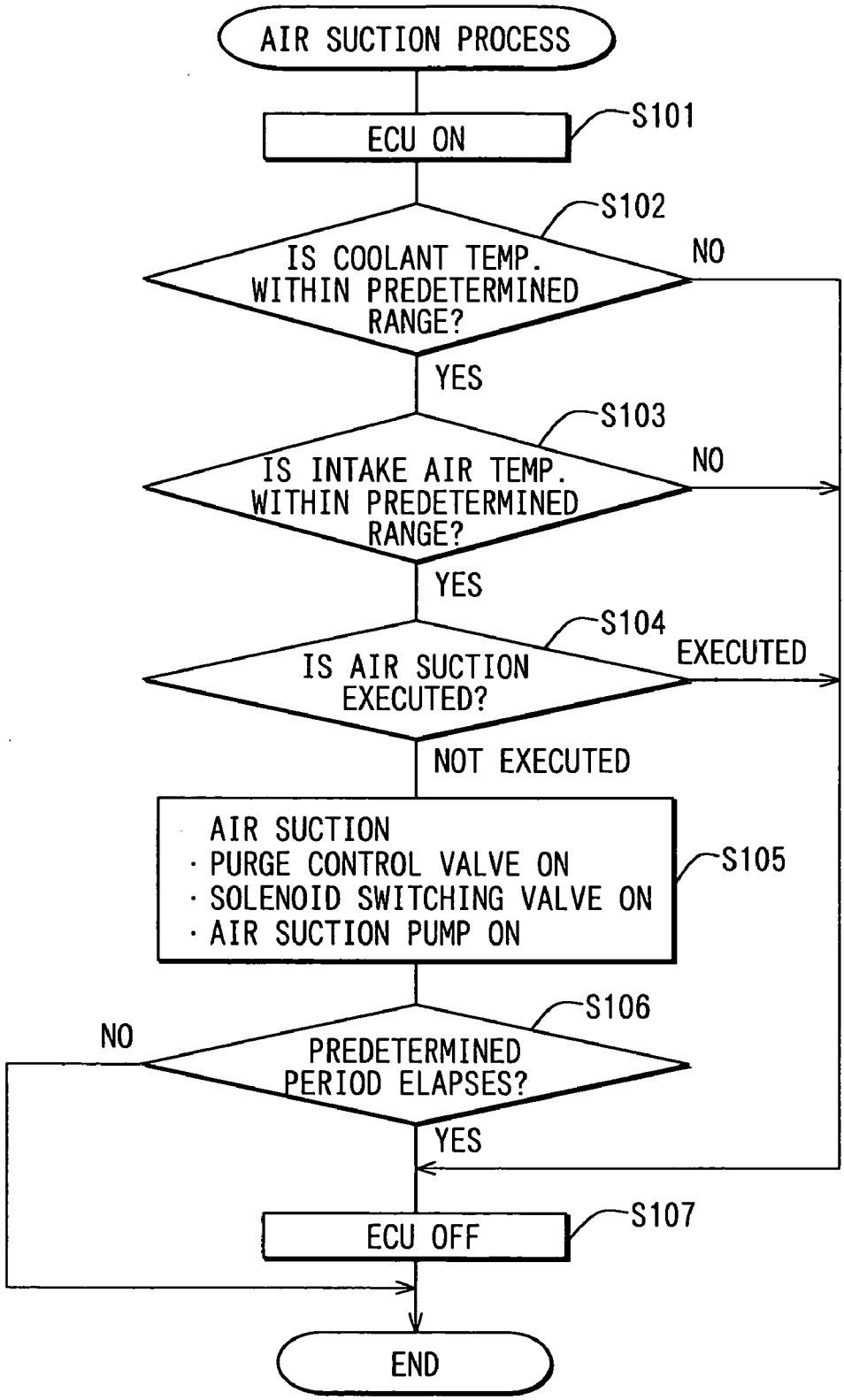
FIG. 2 is a flow diagram showing an air suction process.

FIG. 2 is a flow diagram showing an air suction process which is executed by the ECU 50. When the soak timer 51 counts a predetermined time, the air suction process is started. The air suction process is started after a lapse of ninety minutes or more since the engine is stopped (an ignition switch is turned off). The air suction process is preferably processed when the fuel leakage from the fuel injector 17 is stopped and the HC concentration at the vicinity of the intake port is stabilized. In this embodiment, the air suction process is executed after a lapse of six hours since the engine is stopped.

Referring to FIG. 2, in step S101, the ECU 50 is turned ON to operate devices concerned with the air suction process. In steps S102–S104, the condition for air suction process is determined. That is, in step S102, it is determined whether an engine coolant temperature is within a predetermined range (for example, 0° C.–60° C.), in step S103, it is determined whether the intake air temperature is within a predetermined range (for example, 0° C.–60° C.), and in step S104, it is determined whether the air suction is executed after the engine is stopped. It may be required for executing the air suction that the engine oil temperature or torque converter oil temperature is with in a predetermined range. When the conditions described above are enough to execute the air suction process, the solenoid switching valve 41 and the air suction pump 43 are turned on to suck air. When the engine coolant temperature or the intake air temperature is above the predetermined value, a temperature at the vicinity of the intake port (the intake manifold 16) is high so that the vicinity of the intake port may be filled with the HC of high boiling point. Therefore, the air suction by the air suction pump 43 is restricted until the HC of high boiling point is liquefied according as the temperature at the vicinity of intake port decreases.

When the purge control valve 35 is turned on to communicate the intake manifold 16 and the canister 33, the air suction pump 43 is driven to suck air whereby the floating HC at the vicinity of the intake port is sucked through the purge pipe 34 and absorbed to the canister 33. The speed of the air suction pump 43 is restricted so as to prevent the air from passing through the canister 33 without absorbing. In this embodiment, the air suction pump 43 is driven intermittently, or the driving voltage or current applied to the air suction pump 43 is restricted to restrict the velocity of airflow.

In step S106, it is determined whether the predetermined period (for example, one minute) elapses after the starting of air suction. When it is in the predetermined period, the air suction process is finished. When the predetermined period elapse, the process advances to step S107 to turn off the ECU 50.

Figure 3:
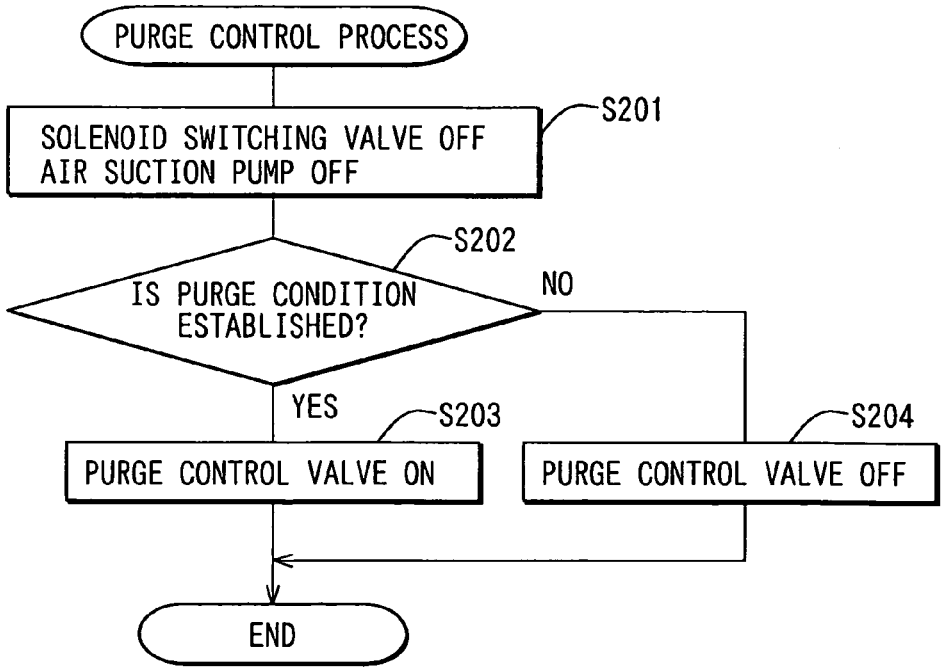
FIG. 3 is a flow diagram showing a purge control process.

After the fuel (HC) is absorbed in the canister 33, the purge control valve 35 opens the purge pipe 34 to purge the fuel according to the engine condition. FIG. 3 is a flow chart showing a purge control process conducted by the ECU 50.

In step S201 of FIG. 3, the electric solenoid valve 41 and the air suction pump 43 are turned off. In step S202, it is determined whether a canister purge condition is established or not. The canister purge condition is well known condition such that the engine speed is over the predetermined value; the amount of intake air is over the predetermined value and the like.

When the purge condition is established, the purge control valve 35 is turned on to purge the fuel absorbed in the canister 33 in steps S203. Thus, the canister 33 restores a HC absorbing capacity thereof. When the purge condition is not established, the purge control valve 35 is turned off in step S204.

The present embodiment has advantages described below.

While the engine is stopped, air is sucked through the purge pipe 34 to absorb the floating HC at the vicinity of the intake valve in the canister 33 effectively. While the engine is running, the HC of high boiling point floats at the vicinity of the intake port by a blowing back of the fuel and the floating HC is not absorbed in the canister 33 so that the absorbing capacity of the canister 33 is not deteriorated. When the engine is re-started, it is restricted that the floating HC is introduced into the combustion chamber and that the floating HC is exhausted as unburned HC. Thus, the emission of HC is reduced.

The canister 33 is utilized as the HC absorbent and air suction pump 43 of the leak check module 40 is utilized for drawing air at the vicinity of the intake port.

Since the purge pipe 34 is connected to the intake manifold 16 in the present embodiment, the HC at the vicinity of the intake port is effectively sucked. On the contrary, if the purge pipe 34 is connected to the intake pipe 11 upstream of the throttle valve 14, air is sucked from the intake pipe 11 so that the floating HC cannot be sucked enough. It is desirable that the purge pipe 34 is connected to a downstream in which a volume is half of the surge tank 15 and the intake manifold 16.

Figure 4:
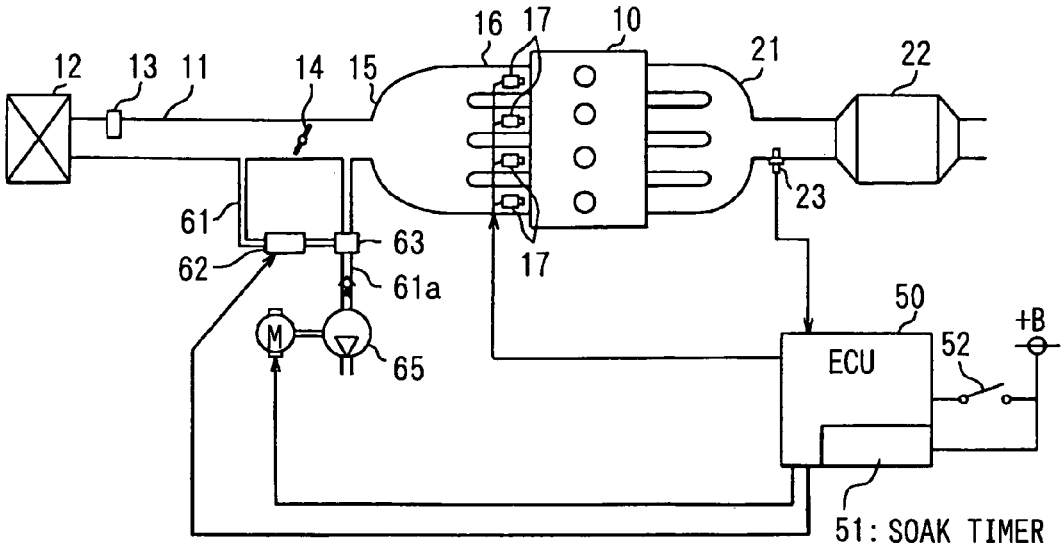
FIG. 4 is a schematic view of an engine control system according to a modification of the first embodiment.

The present invention is not limited to the embodiment described above. Modifications are described herein after referring to FIG. 4 to FIG. 6.

In the first embodiment, the canister 33 of the fuel vapor restraining apparatus is used as the HC absorbent. In the modification shown in FIG. 4, such a structure is modified. The same parts and components as those in the first embodiment are indicated with the same reference numerals and the same descriptions are not reiterated. The intake pipe 11 is provided with a bypass passage 61 having an idle speed control valve 62. A HC absorbent 63 is provided in the bypass passage 61. The bypass passage 61 has a branch passage 61*a* in which an air suction pump 65 is provided. When the air suction pump 65 is operated with the engine off, the floating HC at the vicinity of the intake port is introduced into the HC absorbent 63 through the bypass passage 61. The bypass passage 61 including the branch passage 61*a* forms a part of air suction passage so that an increase in cost is restricted. When the engine is driven, the idle speed control valve 62 opens the bypass passage 61 to purge the absorbed HC in the HC absorbent 63.

Figure 5:
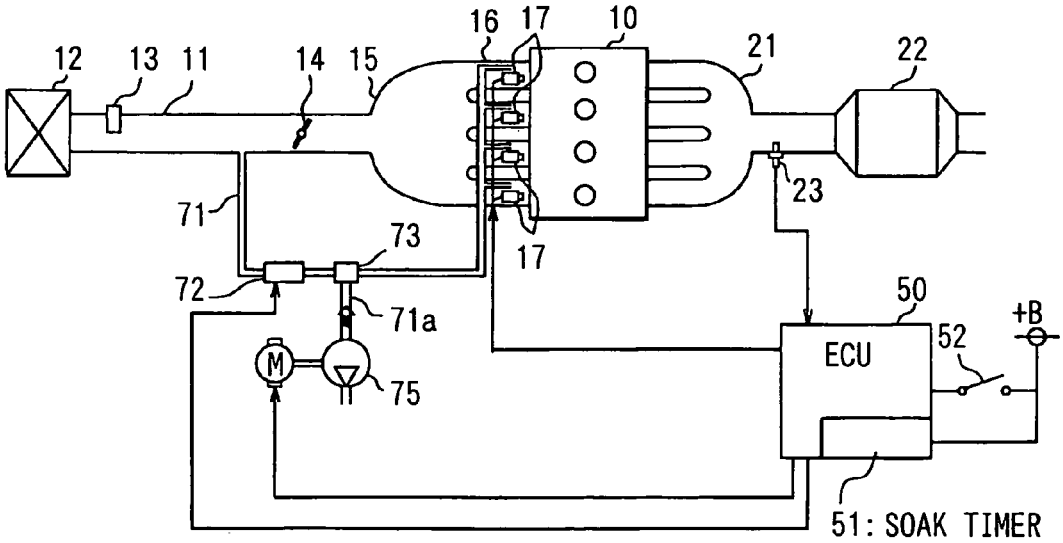
FIG. 5 is a schematic view of an engine control system according to another modification of the first embodiment.

In a modification shown in FIG. 5, the fuel injector 17 is an air-assist injector which injects fuel with assist air to atomize the injected fuel. An assist-air supply passage 71 connects the intake pipe 11 with the fuel injector 17. An electric solenoid valve 72 and a HC absorbent 73 is provided in the assist-air supply passage 71. The assist-air supply passage 71 has a branch passage 71*a* in which an air suction pump 75 is provided. When the air suction pump 75 is operated with the engine off, the floating HC at the vicinity of the intake port is introduced into the HC absorbent 73 through the assist-air supply passage 71. Since the assist-air passage 71 is opened at a top end of the fuel injector 17, the floating HC at the vicinity of the intake port is drawn effectively. The assist-air supply passage 71 including the branch passage 71*a* forms a part of an air suction passage so that an increase in cost is restricted. When the engine is driven, the electric solenoid valve 72 opens the assist-air supply passage 71 to purge the absorbed HC in the HC absorbent 73.

Figure 6:
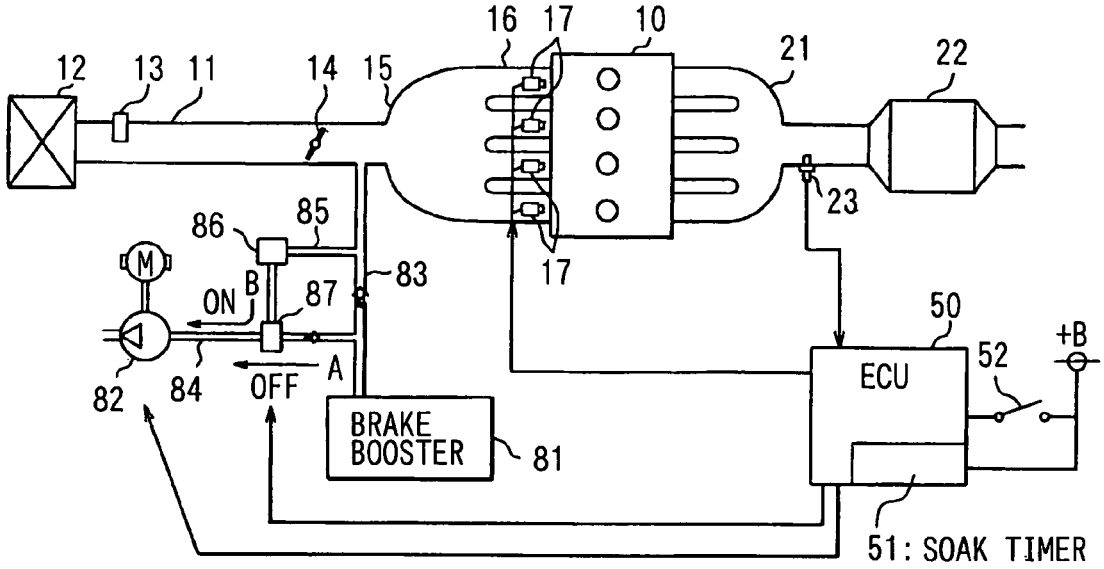
FIG. 6 is a schematic view of an engine control system according to other modification of the first embodiment.

In a modification shown in FIG. 6, a brake booster 81 and a vacuum pump 82 are provided, vacuum pump 82 being utilized as an air suction pump. An air suction pipe 83 communicates the intake pipe 11 with the brake booster 81. The air suction pipe 83 has a branch pipe 84 in which an air suction pump 82 is provided. A bypass pipe 85 connects the air suction pipe 83 with the branch pipe 84. A HC absorbent 86 is provided in the bypass pipe 85. A three-way valve 87 is provided at a connecting portion of the branch pipe 84 and the bypass pipe 85. When the three-way valve 87 is turned off, the airflow shown by an arrow "A" in FIG. 6 is established. When the three-way valve 87 is turned on, the airflow shown by an arrow "B" is established. In the present modification, the three-way valve 82 is turned on with the engine off, thus the floating HC at the vicinity of the intake port is absorbed by the HC absorbent 86. The vacuum pump 82 is used as the air suction pump so that an increase in cost is restricted.

The HC absorbent is an activated carbon, a zeolite or a catalyst having a HC absorbing function.

The air suction pump is operated with the engine off when a door lock of a vehicle is opened or when a door is opened. In order to reduce HC emission at cranking of engine effectively, it is desirable to draw the floating HC at the vicinity of the intake port just before cranking of engine.

A second embodiment of the present invention is described herein after.

Figure 7:
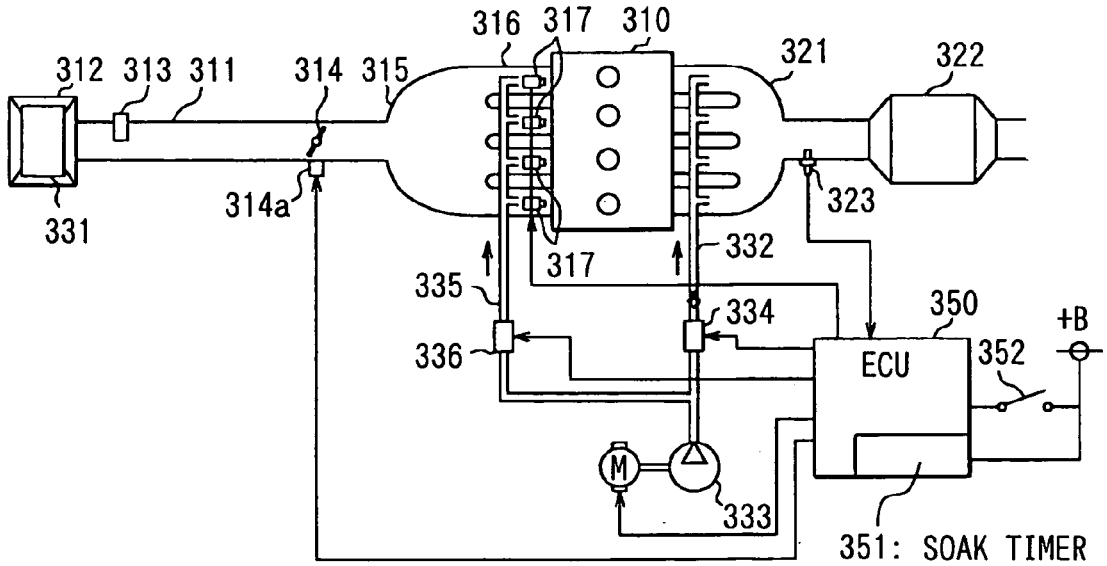
FIG. 7 is a schematic view of an engine control system according to a second embodiment of the present invention.

Referring to FIG. 7, an air-cleaner 312 is disposed at an inlet of an intake pipe 311, and airflow meter 313 for measuring the amount of air passing through the intake pipe 311 is disposed in the intake pipe 311, the airflow meter 313 being disposed downstream of the air-cleaner 312. The airflow meter 313 is provided with an intake air temperature sensor (not shown) therein. A throttle valve 314 is provided downstream of the airflow meter 313, which is controlled an opening degree thereof by a throttle actuator 314*a* such as an DC motor and the like. A surge tank 315 is connected with the intake pipe 311 downstream of the throttle valve 314. An intake manifold 316 for introducing an air into the each cylinder is connected with the surge tank 315. A fuel injector 317 is provided at each intake port of the intake manifold 316. An intake passage is comprised of the intake pipe 311, the surge tank 315 and the intake manifold 316.

A catalyst 322 such as three-way catalyst is disposed in an exhaust pipe 321 for purifying CO, HC, $NO_x$ and the like in the emissions. An A/F sensor 323 which detects a ratio of air and fuel is disposed upstream of the catalyst 322. The A/F sensor 323 is a linear A/F sensor or an oxygen sensor.

The air-cleaner 312 is provided with a HC absorbent 331 such as an activated carbon, a zeolite, and a catalyst having a HC absorbing function.

A secondary air is supplied to the catalyst 322 to activate the catalyst 322 rapidly. An exhaust-side air passage 332 is connected with the exhaust pipe 321 to introduce the secondary air into the exhaust pipe 321 from the secondary-air supply pump 333. An exhaust-side valve 334 is provided in the exhaust-side air passage 332. An intake-side air passage 335 is branched from the exhaust-side air passage 332 between the secondary-air supply pump 333 and the exhaust-side valve 334. Another end of the intake-side air passage 335 communicates with the intake manifold 316. An intake-side valve 336 is provided in the intake-side air passage 335. The secondary-air supply pump 333 corresponds to an air injection means and the exhaust-side and intake-side valve 334, 336 correspond to a control valve in the present invention.

When the engine 310 is started, the exhaust-side valve 334 opens the exhaust-side air passage 332 to introduce the secondary air into the exhaust pipe 321 so that the catalyst 322 is activated rapidly. While the engine 310 is stopped, the intake-side air passage 336 opens the intake-side air passage 335 to introduce the secondary air into the intake manifold 316, especially into a vicinity of the intake port.

An electrical control unit 350, which is referred to as ECU 350 herein after, includes a micro-computer and receives an A/F detection signal from the A/F sensor 323, an air amount signal, an air temperature signal, an engine coolant temperature signal, an engine speed signal, a throttle opening signal and an ignition signal from an ignition switch 352. The ignition switch 352 is referred to as IG switch 352 herein after. The ECU 350 controls the operation of the fuel injection valve 317, the throttle actuator 14*a*, the secondary-air supply pump 333, the exhaust-side valve 334 and the intake-side valve 334. The ECU 350 has a soak timer 351 for measuring an elapsed time since the engine 310 is stopped.

In the present embodiment, while the engine is stopped, a secondary air is injected into the vicinity of the intake port so that the floating HC is blown toward the HC absorbent 331.

Figure 8:
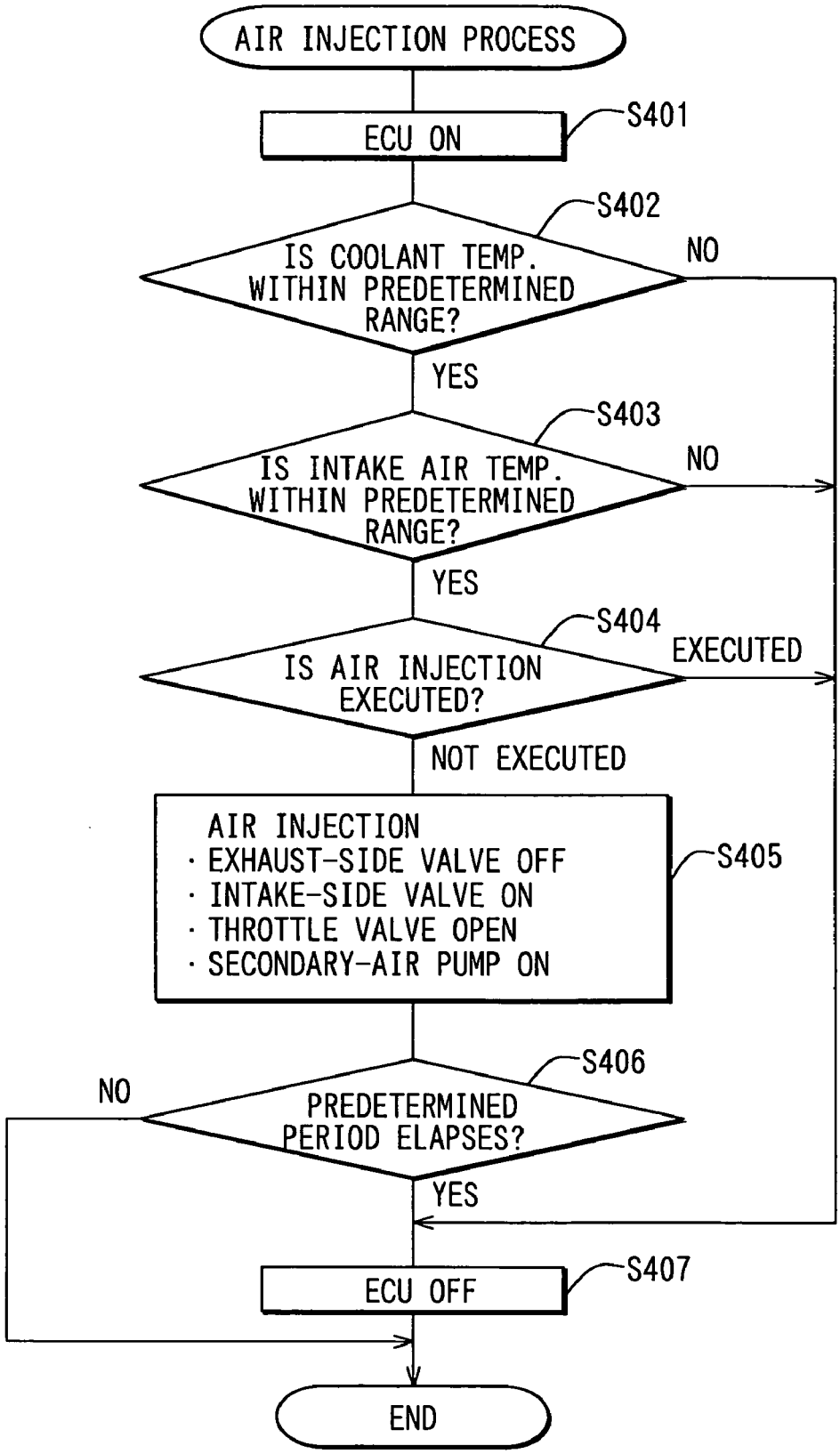
FIG. 8 is a flow diagram showing an air injection process.

FIG. 8 is a flow diagram showing an air suction process which is executed by the ECU 50. When the soak timer 51 counts a predetermined time, the air suction process is started. The air suction process is started after a lapse of ninety minutes or more since the engine is stopped (an ignition switch is turned off). The air suction process is preferably processed when the fuel leakage from the fuel injector 17 is stopped and the HC concentration at the vicinity of the intake port is stabilized. In this embodiment, the air suction process is executed after a lapse of six hours since the engine is stopped.

Referring to FIG. 8, in step S401, the ECU 350 is turned on to operate devices concerned with the air injection process. In steps S402–S404, the condition for air injection process is determined. That is, in step S402, it is determined whether an engine coolant temperature is within a predetermined range (for example, 0° C.–60° C.), in step S403, it is determined whether the intake air temperature is within a predetermined range (for example, 0° C.–60° C.), and in step S404, it is determined whether the air injection process is executed after the engine is stopped. It may be required for executing the air injection process that the engine oil temperature and/or torque converter oil temperature is within a predetermined range. When the conditions described above are enough to execute the air suction process, step S405 is executed. In step S405, the exhaust-side valve 334 is turned off to close the exhaust-side air passage 332, the intake-side valve 336 is turned on to open the intake-side air passage 335, throttle valve 314 is controlled to a predetermined opening degree and the secondary-air supply pump 333 is driven to inject the secondary air. When the engine coolant temperature or the intake air temperature is above the predetermined value, a temperature at the vicinity of the intake port may be filled with the HC of high boiling point. Therefore, the air injection is restricted until the HC of the high boiling point is liquefied according as the temperature at the vicinity of intake port decreases.

The secondary air is introduced into the intake manifold 316 by the secondary-air supply pump 333 so that airflow is formed in the intake pipe 311 and the intake manifold 316. The floating HC at the vicinity of the intake port is introduced toward the upstream of intake pipe 311 and is absorbed by the HC absorbent 331. The speed of the secondary-air supply pump 333 is restricted so as to prevent the air including HC from passing through the HC absorbent 331 without absorbing HC. If the secondary-air supply pump 333 is driven to supply the secondary air to the intake manifold 316 the same as the pump 333 is driven to the secondary air to the exhaust manifold 321, the HC passes through the HC absorbent 331. Therefore, the speed of the pump in supplying the air to the intake side is lower than that in supplying the air to the exhaust side. In this embodiment, the secondary-air supply pump 333 is driven intermittently, or the driving voltage or current applied to the pump 333 is restricted to control the velocity of the air.

In step S407, it is determined whether a predetermined period (for example, about one minute) elapses after the air injection. When the predetermined period does not elapse, the air injection process is finished. When the predetermined period elapses, a power source for ECU is cut off in step S407

The absorbed HC in the HC absorbent 331 is purged into the intake air and is introduced into a combustion chamber with the intake air while the engine 310 is driven. Then the purged HC is burned with the fuel injected from the fuel injector 317. Since the HC is purged from the HC absorbent 331, the absorbing capacity of the HC absorbent 331 is restored. The HC absorbed in the absorbent 331 is not purged when the engine is cranked, thus the purged HC is not introduced into the combustion chamber before combustion starts.

Figure 9:
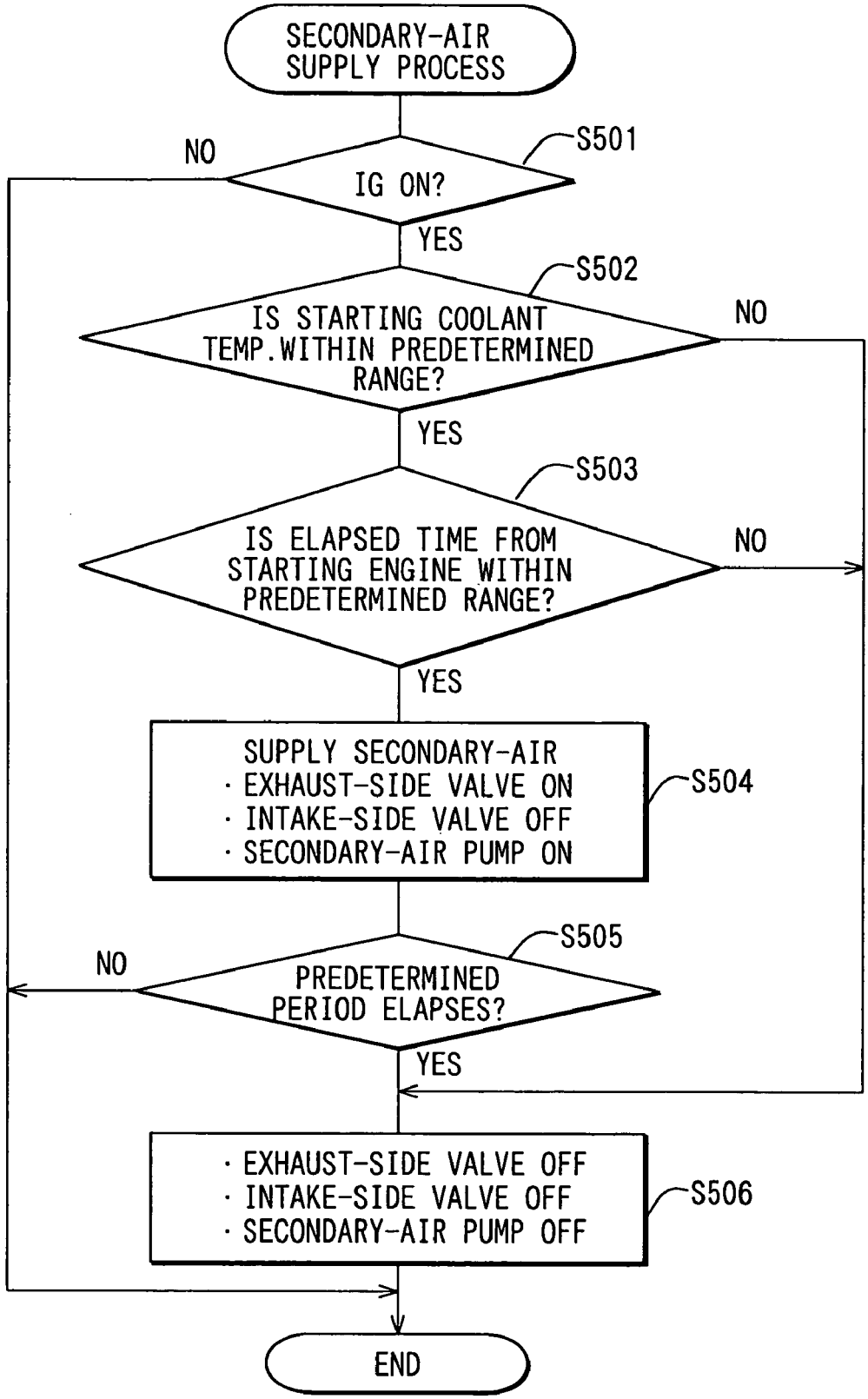
FIG. 9 is a flow diagram showing a secondary-air supply process.

FIG. 9 is a flow diagram showing a secondary-air supply process which is executed by the ECU 350 at every predetermined period.

In step S501, it is determined whether the ignition switch 352 is turned on. When the ignition switch is turned on, it is determined whether the engine coolant temperature is within predetermined range (for example, 0° C.–60° C.) in step S502. In step S503, it is determined whether an elapsed time from stating of engine is within a predetermined range (for example, one minute). When the determination "YES" is made in step S502 and step S503, the process is advanced to step S504 in which the exhaust-side valve 334 is turned on to open the passage 332, the intake-side valve 336 is turned off to close the passage 335 and the secondary-air supply pump 333 is driven to supply the secondary air to the exhaust pipe 321.

In step S505, it is determined whether a predetermined period (for example, one minute) elapses after secondary-air injection. When the determination is "NO" in step S505, the present process is finished. When the determination is "YES", the exhaust-side valve is turned off, the intake-side valve is turned off and the secondary-air supply pump 333 is stopped to terminate secondary air injection into the exhaust pipe 321.

The second embodiment described above has following advantages.

The HC floating at the vicinity of the intake port is absorbed in the HC absorbent 331 effectively by the secondary air injection during engine stop. Since the HC absorbent 331 is disposed in the air cleaner 312 into which less HC is floating, the HC is not absorbed in the HC absorbent 331 with engine on so that the deterioration of absorbing capacity of the absorbent 331 is restricted. Thus, in the next starting of engine, it is restricted that the floating HC is introduced into the combustion chamber and is exhausted as unburned gas. The HC emission is reduced. Furthermore, since the secondary-air supply pump 333 is utilized as an air injection means, an increase in cost is restricted.

Since the intake-side air passage 335 is connected with the intake manifold 316, the HC floating at the vicinity of the intake port is effectively removed. On the contrary, if the air passage 335 is connected to the intake pipe 11 close to the throttle valve 314, air does not flow upstream of the throttle valve 314 so that the floating HC can not absorbed enough. It is desirable that the intake-side air passage 335 is connected to a downstream in which a volume is half of the surge tank 315 and the intake manifold 316.

Modifications of the second embodiment are described below referring to FIG. 10 and FIG. 11.

Figure 10:
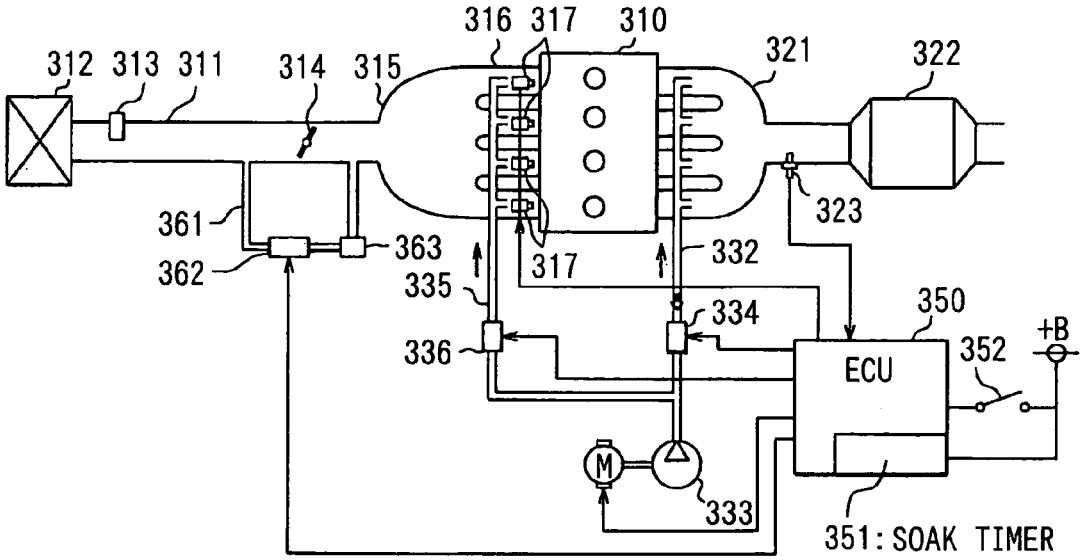
FIG. 10 is a schematic view of an engine control system according to a modification of the second embodiment.

The modification shown in FIG. 10 has bypass passage 361 which is connected with the intake pipe 311 with bypassing the throttle valve 314. The bypass passage 361 is provided with an idle speed control valve 362 and a HC absorbent 363. A secondary-air supply pump 33 is driven to inject secondary air while the engine is running, and then the floating air floating at the vicinity of the intake port is introduced into the HC absorbent 363 through the bypass passage 361. At this moment, the throttle valve 314 is closed and the idle speed control valve 362 is opened in a predetermined degree. In this modification, since the bypass passage 361 is utilized as a passage for introducing the HC to the HC absorbent, an increase in cost is restricted. While the engine is running, the idle speed control valve 362 is opened to purge the HC absorbed in the HC absorbent 363.

Figure 11:
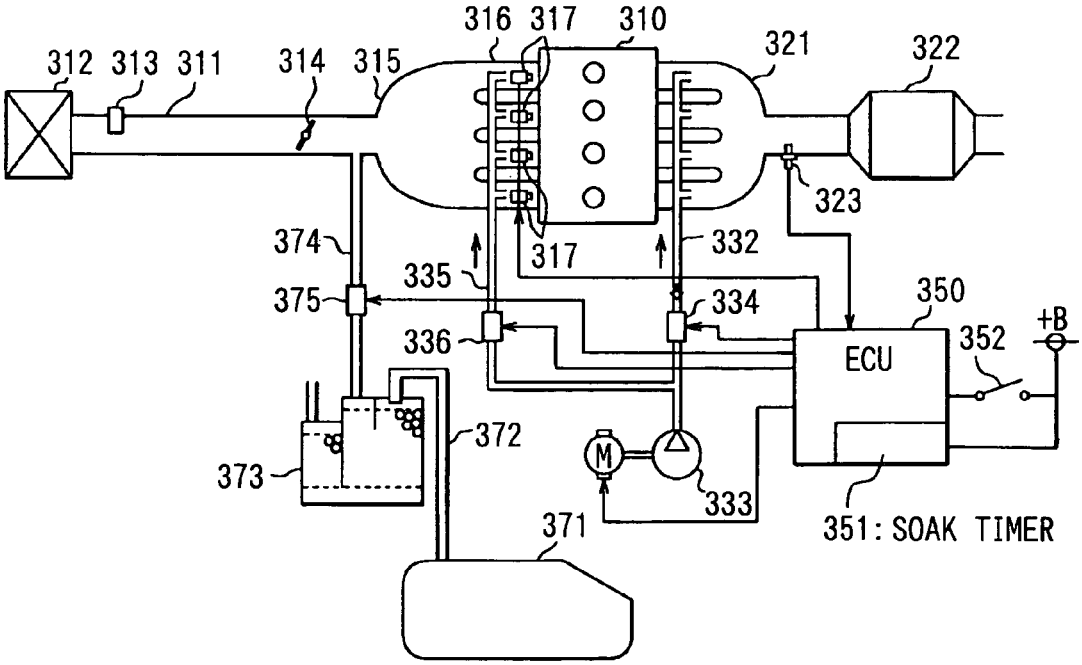
FIG. 11 is a schematic view of an engine control system according to another modification of the second embodiment.

Referring to FIG. 11, the system is provided with a feel vapor restraining apparatus to restrict HC emission. One end of the introducing pipe 372 is connected with a fuel tank 371 and the other end of the pipe 372 is connected with a canister 373. The canister 373 is filled with absorbents such as activated carbons for absorbing a HC evaporated in the fuel tank 373. The canister 373 is connected with the intake pipe 311 through the purge pipe 374, which is provided with an electric-solenoid-type purge control valve 375. The purge valve 375 controls the amount of the HC which is purged into the intake pipe 311. When the secondary-air supply pump 333 injects the secondary air with the engine off, the floating HC is introduced into the canister 373 through the purge pipe 374. At this moment, the throttle valve 314 is closed and the purge control valve 375 is opened in a predetermined degree. Since the canister 333 is utilized as the HC absorbent, an increase in cost is restricted.

The secondary air may be injected into the intake manifold 316 directly without the intake-side air passage 335. In this case, an air pump is mounted on the intake manifold 316.

An air-assist injector which injects fuel with assist air to atomize the injected fuel can be used. The secondary-air supply air pump 333 supplies air to the air-assist injector. Since the assist air is injected from a top end of the injector, the floating HC at the vicinity of the intake port is removed effectively. Since the assist air is injected from an injection port of the injector, an increase in cost is restricted.

The secondary-air supply pump 333 may be operated with the engine off when a door lock of a vehicle is opened or when a door is opened. In order to reduce HC emission at cranking of engine effectively, it is desirable to remove the floating HC at the vicinity of the intake port just before cranking of engine. Thus, the HC emission is reduced when the engine is at cranking.

The secondary-air supply pump 333 can be replaced by another air pump as air supply means.

What is claimed is:

1. An apparatus for reducing hydrocarbon emissions of an internal combustion engine, comprising:

an air suction passage connected with an intake pipe downstream of a throttle valve;

a HC absorbent disposed in the air suction passage for absorbing hydrocarbon; and an air suction pump communicating with the air suction passage, wherein the air suction pump is driven with the engine off in order to draw the hydrocarbon floating at a vicinity of an intake port; and the air suction pump is prevented from being driven when a temperature of the internal combustion engine is above a predetermined value.

2. The apparatus for reducing hydrocarbon emissions of an internal combustion engine according to claim 1, wherein the internal combustion engine is a multi-cylinder internal combustion engine, and the air suction passage communicates with an intake manifold.

3. The apparatus for reducing hydrocarbon emissions of an internal combustion engine according to claim 1, wherein the HC absorbent is disposed at a place through which air is introduced into the intake pipe when the internal combustion engine is running.

4. The apparatus for reducing hydrocarbon emissions of an internal combustion engine according to claim 1, wherein the air suction passage is opened to purge the hydrocarbon into the intake pipe, the hydrocarbon being absorbed in the HC absorbent.

5. The apparatus for reducing hydrocarbon emissions of an internal combustion engine according to claim 1, further comprising:

a fuel vapor restraining apparatus for absorbing a fuel vapor, which includes a canister and a purge passage communicating the canister with the intake pipe, wherein the fuel vapor absorbed by the canister is purged into the intake pipe through the purge passage while the engine is running, and the intake pipe and the canister communicates with each other while the engine is not running.

6. The apparatus for reducing hydrocarbon emissions of an internal combustion engine according to claim 5, further comprising:

a purge control valve disposed in the purge passage for opening or closing the purge passage, the purge control valve opening the purge passage to purge the hydrocarbon according to an engine condition.

7. The apparatus for reducing hydrocarbon emissions of an internal combustion engine according to claim 5, further comprising:

a leak check module for detecting a gas leak from a fuel vapor passage which connects a fuel tank and the canister.

8. The apparatus for reducing hydrocarbon emissions of an internal combustion engine according to claim 1, further comprising:

a bypass passage connected with the intake pipe to bypass the throttle valve, and an idle speed control valve disposed in the bypass passage, wherein the HC absorbent is disposed in the bypass passage which is utilized as the air suction passage.

9. The apparatus for reducing hydrocarbon emissions of an internal combustion engine according to claim 1, further comprising:

an air-assist injector which injects fuel with air to atomize the injected fuel, the air being supplied through an assist air passage which is utilized as the air suction passage, and the assist air passage being provided with the HC absorbent.

10. The apparatus for reducing hydrocarbon emissions of an internal combustion engine according to claim 1, further comprising:

a brake booster for multiplying a braking force; and a vacuum pump for introducing vacuum into the brake booster, wherein the vacuum pump is utilized as the air suction pump.

11. The apparatus for reducing hydrocarbon emissions of an internal combustion engine according to claim 1, wherein a velocity of air sucked by the air suction pump is restricted in such a manner that hydrocarbon hardly passes through the HC absorbent.

12. The apparatus for reducing hydrocarbon emissions of an internal combustion engine according to claim 1, wherein the air suction pump is driven when a predetermined soak period elapses after the internal combustion engine is turned off.

13. An apparatus for reducing hydrocarbon emissions of an internal combustion engine, comprising:

an air suction passage connected with an intake pipe downstream of a throttle valve;

a HC absorbent disposed in the air suction passage for absorbing hydrocarbon; and an air suction pump communicating with the air suction passage, wherein the air suction pump is driven with the engine off in order to draw the hydrocarbon floating at a vicinity of an intake port; and the air suction pump is driven when a door lock is released or when a door is opened.

14. An apparatus for reducing hydrocarbon emissions of an internal combustion engine, comprising:

an air injection means for injecting secondary air into an intake pipe at an intake port or a vicinity thereof; and a HC absorbent for absorbing hydrocarbon, the HC absorbent being disposed at a place which communicates with the vicinity of the intake port and into which the hydrocarbon of high boiling point hardly flows, wherein the air injection means injects the secondary air when the internal combustion engine is off; and the air injection means is prevented from air-injection when a temperature of the internal combustion engine is above a predetermined value.

15. The apparatus for reducing hydrocarbon emissions of an internal combustion engine according to claim 14, further comprising:

an air injection passage communicated with the intake port or a vicinity of the intake port, wherein the air injection means injects the secondary air through the air injection passage.

16. The apparatus for reducing hydrocarbon emissions of an internal combustion engine according to claim 14, wherein the internal combustion engine is a multi-cylinder internal combustion engine, and the air injection passage communicates with an intake manifold.

17. The apparatus for reducing hydrocarbon emissions of an internal combustion engine according to claim 14, further comprising:

an air-assist injector which injects fuel with air through an assist-air injection port to atomize the injected fuel, the air injection means injecting the air toward the assist-air injection port.

18. The apparatus for reducing hydrocarbon emissions of an internal combustion engine according to claim 14, wherein the HC absorbent is disposed at a place through which an air is introduced into a combustion chamber when the internal combustion engine is kept running.

19. The apparatus for reducing hydrocarbon emissions of an internal combustion engine according to claim 14, wherein the HC absorbent is disposed in an air cleaner which is provided at an upstream end of the intake pipe.

20. An apparatus for reducing hydrocarbon emissions of an internal combustion engine, comprising:

an air injection means for injecting secondary air into an intake pipe at an intake port or a vicinity thereof; and a HC absorbent for absorbing hydrocarbon, the HC absorbent being disposed at a place which communicates with the vicinity of the intake port and into which the hydrocarbon of high boiling point hardly flows, wherein the air injection means injects the secondary air when the internal combustion engine is off;

the HC absorbent is disposed in an air cleaner which is provided at an upstream end of the intake pipe;

a throttle valve disposed in the intake pipe is opened at an angle of a predetermined degree when the air injection means injects the air.

21. The apparatus for reducing hydrocarbon emissions of an internal combustion engine according to claim 14, further comprising:

a fuel vapor restraining apparatus for absorbing a fuel vapor, which includes a canister and a purge passage communicating the canister with the intake pipe, wherein the fuel vapor absorbed by the canister is purged into the intake pipe through the purge passage when the engine is running, and the intake pipe and the canister communicates with each other when the engine is not running.

22. The apparatus for reducing hydrocarbon emissions of an internal combustion engine according to claim 21, further comprising:

a purge control valve disposed in the purge passage for opening or closing the purge passage, the purge control valve opening the purge passage to purge the hydrocarbon according to an engine condition.

23. The apparatus for reducing hydrocarbon emissions of an internal combustion engine according to claim 14, further comprising:

a bypass passage communicated with the intake pipe to bypass the throttle valve, and an idle speed control valve disposed in the bypass passage, wherein the HC absorbent is disposed in the bypass passage which is utilized as the air suction passage.

24. The apparatus for reducing hydrocarbon emissions of an internal combustion engine according to claim 14, further comprising:

a catalyst for purifying an emission exhausted from the internal combustion engine;

a secondary-air supply pump for supplying a secondary air to the catalyst, wherein the secondary-air supply pump is utilized as the air injection means for injecting the secondary air into the vicinity of the intake port.

25. The apparatus for reducing hydrocarbon emission of an internal combustion engine according to claim 14, wherein the secondary-air supply pump communicates with an exhaust pipe through an exhaust-side air passage and communicates with the intake pipe through an intake-side air passage, the exhaust-side air passage and the intake-side air passage are opened or closed by a control valve, and the exhaust-side passage is closed and the intake-side passage is opened by the control valve when the secondary-air injection into the vicinity of the intake port is conducted by the secondary-air supply pump.

26. The apparatus for reducing hydrocarbon emissions of an internal combustion engine according to claim 14, wherein a velocity of air injected by the air injection means is restricted in such a manner that hydrocarbon hardly passes through the HC absorbent.

27. The apparatus for reducing hydrocarbon emissions of an internal combustion engine according to claim 14, wherein the air injection means conducts the air injection when a predetermined soak period elapses after the internal combustion engine is turned off.

28. An apparatus for reducing hydrocarbon emissions of an internal combustion engine, comprising:

an air injection means for injecting secondary air into an intake pipe at an intake port or a vicinity thereof; and a HC absorbent for absorbing hydrocarbon, the HC absorbent being disposed at a place which communicates with the vicinity of the intake port and into which the hydrocarbon of high boiling point hardly flows, wherein the air injection means injects the secondary air when the internal combustion engine is off; and the air injection means conducts the air injection when a door lock is released or when a door is opened.

29. An apparatus for reducing hydrocarbon emission of an internal combustion engine, comprising:

an airflow source for generating an airflow forcibly in an intake pipe; and a HC absorbent disposed downstream of the airflow source for absorbing hydrocarbon, wherein the HC absorbent is disposed at a place into which the hydrocarbon hardly floats, and the airflow source generates the airflow when the internal combustion engine is off and a temperature of the internal combustion engine is not above a predetermined value.

* * * * *